United States Patent [19]

Landsberger et al.

[11] Patent Number: 4,641,384

[45] Date of Patent: Feb. 10, 1987

[54] BATTERY OPERATED EYEWASH SYSTEM

[75] Inventors: David Landsberger, Livingston; John Broeils, Wyckoff, both of N.J.

[73] Assignee: Maddak, Inc., Pequannock, N.J.

[21] Appl. No.: 829,627

[22] Filed: Feb. 14, 1986

[51] Int. Cl.[4] ..... A61H 33/00; A61H 33/04

[52] U.S. Cl. ..... 4/620; 4/619; 4/625; 604/295; 604/296

[58] Field of Search ..... 4/619, 620, 615, 624, 4/625, 661; 239/332, 333, 24, 25, 28, 29, 543, 590.3, 30, 29.3; 128/66; 604/296, 294, 297, 301, 302

[56] References Cited

U.S. PATENT DOCUMENTS 1,246,971 11/1917 Maier ..... 604/297

3,901,449 8/1975 Bochmann ..... 239/333 X 4,012,798 3/1977 Liautaud ..... 4/620

4,363,146 12/1982 Liautaud ..... 4/620

*Primary Examiner*—Henry K. Artis

*Attorney, Agent, or Firm*—Anthony F. Cuoco

[57] ABSTRACT

A battery operated eyewash system is disclosed which includes a liquid spraying device operable by rechargeable batteries through a spring loaded slideable switch, in combination with a hood secured to the liquid spraying device. The liquid spraying device further includes a nozzle which extends in an opening in the front of the hood for spraying liquid into the eye or eyes of a user when the user positions the face in the opening. The slideable switch is operable through a switch actuating mechanism having an operating knob extending through the front of the hood so as to be readily accessible to the user.

7 Claims, 5 Drawing Figures

BATTERY OPERATED EYEWASH SYSTEM

BACKGROUND OF THE INVENTION

Eyewash systems are in wide use in factories, laboratories and other installations where the danger of injury to the eye exists due to splashing of chemicals, and/or dust, dirt and other irritants which may be present. These systems are best portable so that they may be transported to the site of an injury or accident.

Prior art portable eyewash systems include a resiliant liquid container arranged with an eye cup or the like whereby, upon manually squeezing the container, a liquid is dispensed for flushing the eye. Other prior art portable systems dispense the flushing liquid through gravity flow apparatus.

While these systems have the desired portability feature and are hence advantageous over non-portable systems which must be connected to existing plumbing, the liquid dispensing action provided is somewhat unreliable and, in any event, a liquid flushing action is provided rather than a liquid spraying action which is more desirable for the purposes intended.

Accordingly, it is an object of the present invention to provide a battery operated and hence portable eyewash system, wherein a liquid is sprayed for washing the eye, and which system incorporates other desirable features not found in the prior art devices.

SUMMARY OF THE INVENTION

This invention contemplates an eyewash system including liquid spraying means featuring a tank which contains a liquid and a battery operated pump for dispensing the liquid from the tank. A hood is provided and a nozzle extends into an opening in the front of the hood and is coupled to the hood, whereby operation of the pump through a switch actuator accessible from the front of the hood is effective for spraying liquid into the eye or eyes of a user when the user's face is disposed in the hood opening. The eyewash system described has the advantages of being portable, of providing a desirable liquid spray for washing the eye and of being useable with rechargeable batteries to insure that the liquid is dispensed with reliability.

DETAILED DESCRIPTION OF THE INVENTION

Figure 1:
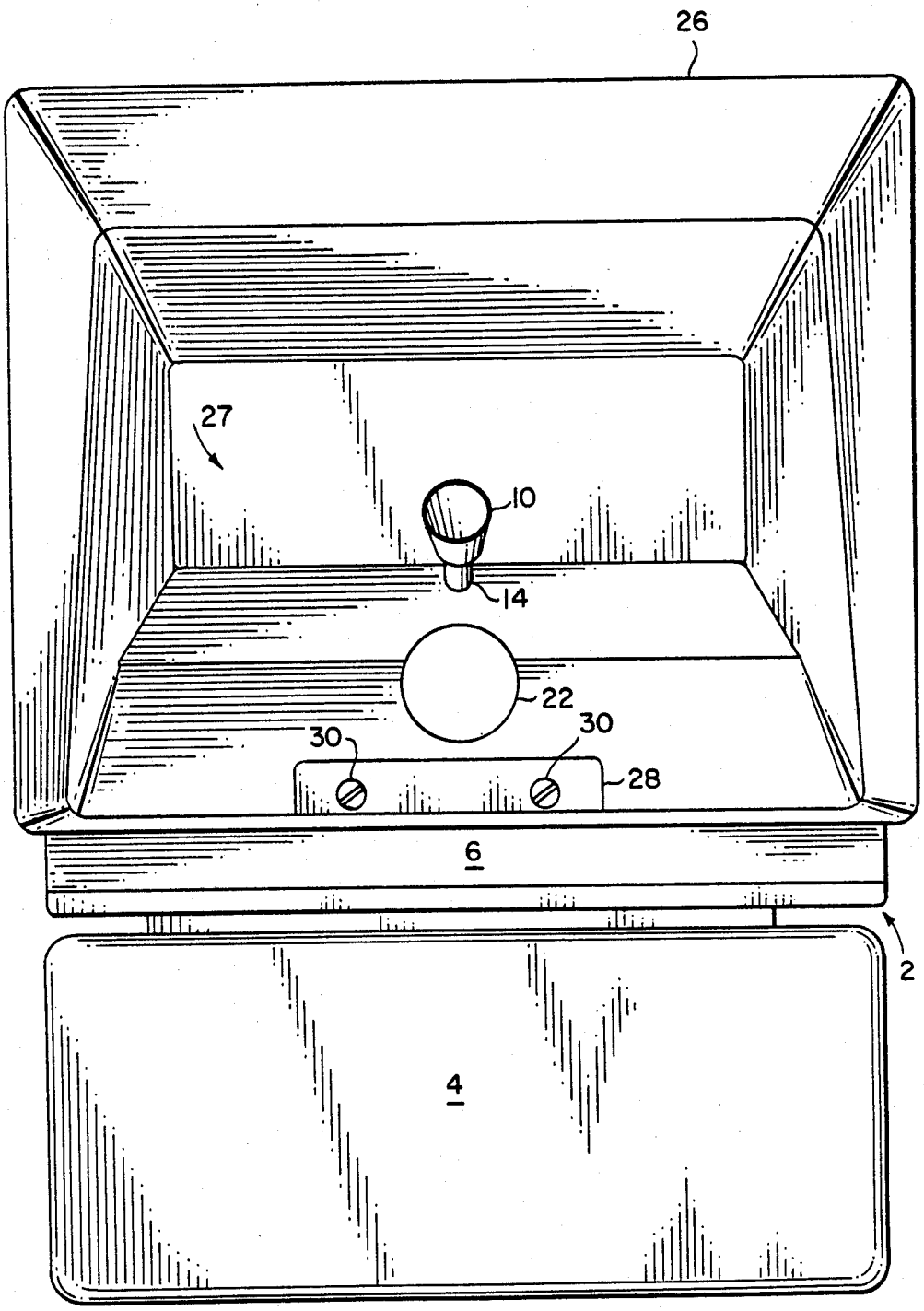
FIG. 1 is a front pictorial view of the eyewash system of the invention.
Figure 2:
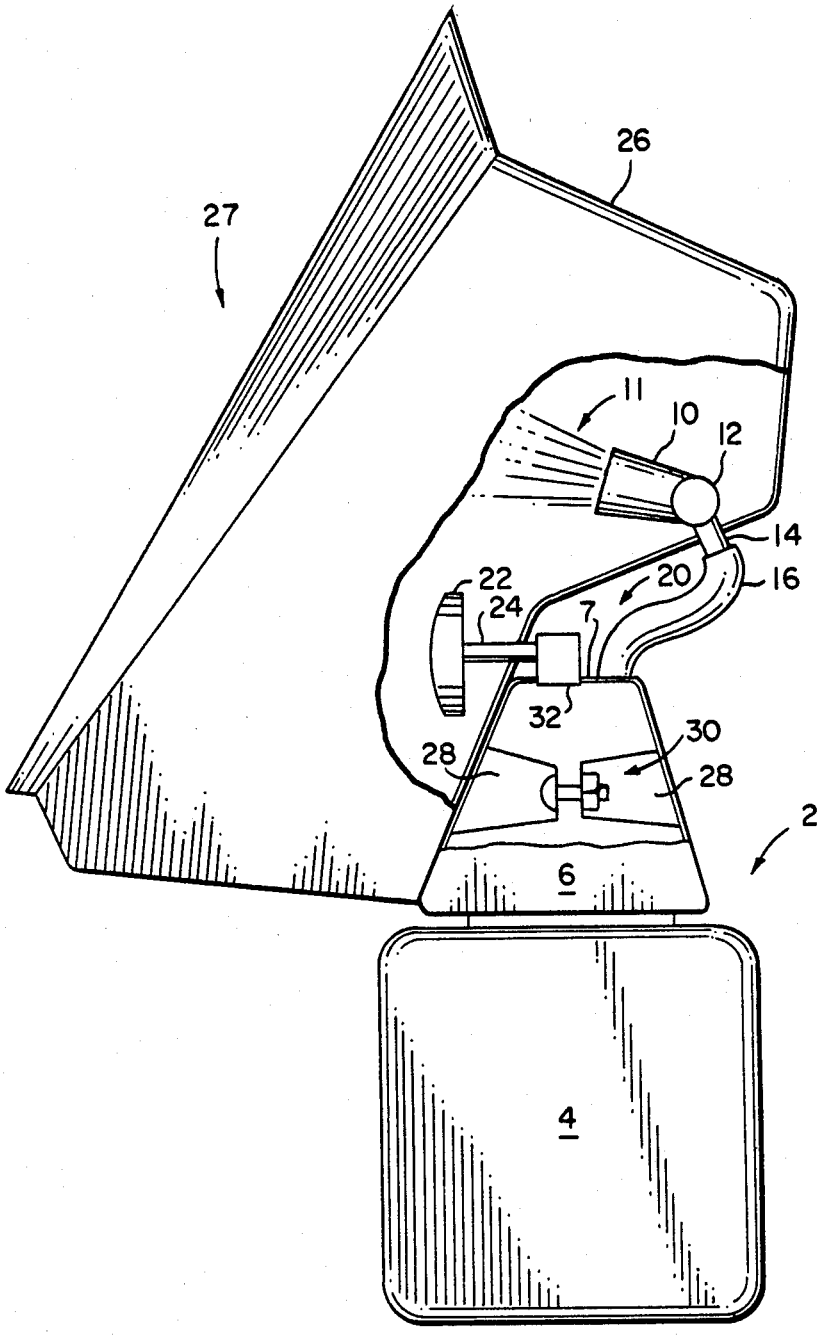
FIG. 2 is a partially cut away diagrammatic right end view relative to FIG. 1.

With reference first to FIGS. 1 and 2, a battery operated liquid spraying device is designated generally by the numeral 2. Liquid spraying device 2 includes a liquid reservoir or tank 4 and a pump and battery housing

6 supported thereby. A rigid tube 8 extends from an outlet port (not otherwise shown) of tank 4.

A spray nozzle 10 is connected through a pivotable fitting 12 to a hollow wand 14. Wand 14 is connected to a flexible tube 16.

Figure 3:
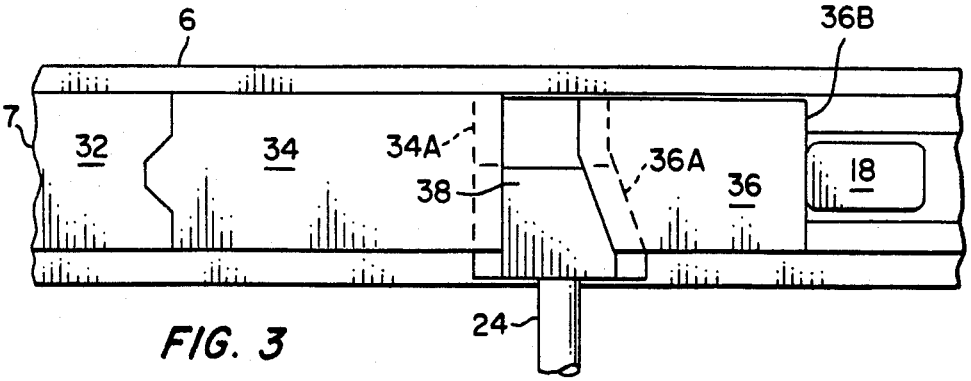
FIG. 3 is a diagrammatic plan view of a switch actuating arrangement for operating the eyewash system of the invention, and showing the switch thereof in an "off" position.
Figure 4:
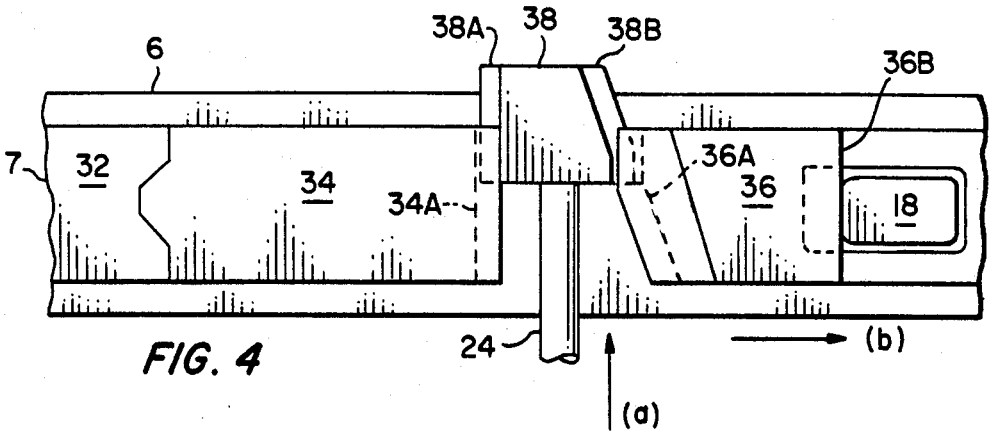
FIG. 4 is a diagrammatic plan view of the switch actuating arrangement, and showing the switch in an "on" position.

Upon actuation of a switch 18 shown in FIGS. 3 and 4, a pump (not otherwise shown) in housing 6 is operated by batteries (not otherwise shown) also in housing 6 for pumping liquid from tank 4 through flexible tube 16 connected to the pump and hollow wand 14 to nozzle 10, whereby a liquid spray 11 is dispensed through the nozzle.

Figure 5:
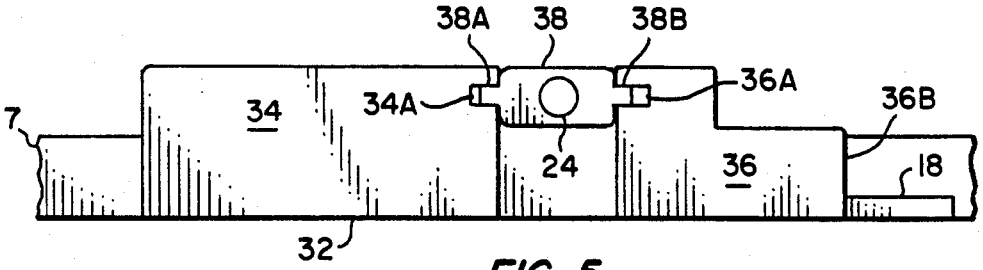
FIG. 5 is a diagrammatic front elevational view showing the switch actuating arrangement otherwise shown in FIGS. 3 and 4.

Switch 18 (FIGS. 3 and 4) is actuated by a switch actuating mechanism 20 shown generally in FIG. 2 and more specifically in FIGS. 3, 4 and 5. As will be hereinafter more fully described, a manually operated knob 22 is mounted to a shaft 24 for operating switch 18 through actuating mechanism 20 to an "off" and "on" position. As indicated by the knob legend in FIG. 1, switch 18 is "on" when knob 22 is pushed in and "off" when knob 22 is pulled out.

Battery operated liquid spraying device 2 is of the commercially available type and features rechargeable batteries for operating a motor which drives the aforenoted pump. Switch 18 extends through the top 7 of pump and battery housing 6 as best shown in FIGS. 3, 4 and 5, and is slideable to on/off positions. A battery operated liquid spraying device of the type suitable for use with the present invention is described and claimed in U.S. Pat. No. 3,901,449 issued to Carl E. Bochmann on Aug. 22, 1975 and assigned to the H.D. Hudson Manufacturing Company, Chicago, Ill., the details of which are incorporated herein by reference. Accordingly, only as much of the device as is necessary to understand the invention is described herein.

With further reference to FIGS. 1 and 2, a rigid eyewash hood 26 is secured to pump and battery housing 6 in front of liquid spraying device 2 by suitable means such as clamps 28 and locking screws and nuts designated generally by the numeral 30 to provide an integral eyewash system. The arrangement is such that when hood 26 is secured to housing 6 as aforenoted, hollow wand 14 and spray nozzle 10 extend through the back of the hood to an opening 27 in the front thereof. Likewise, shaft 24 extends through the back of the hood to the front thereof. Knob 22 is secured to the end of shaft 24 in the front of the hood so as to be readily accessible to a user.

Thus, nozzle 10 may be appropriately positioned through pivotable connection 12 so as to provide a liquid spray for cleansing the eye or eyes of a user when the user positions the face in opening 27 in the front of hood 26 and operates switch actuating mechanism 20 through knob 22. In this connection it is noted that hood 26 is contoured so that the user may position the face in opening 27 and then adjust his face in the opening to aim the affected eye or eyes at the spray, as may be required.

The actuation of switch 18 will now be described with reference to FIGS. 3, 4 and 5.

Pump and battery housing 6 is arranged to have a planar surface 32 on top 7 thereof and behind hood 26 (FIG. 2). Switch 18 extends above surface 32 external to top 7 of housing 6.

Switch actuating mechanism 20 includes a spacer 34 which is fixed on surface 32 and a spacer 36 in spaced relation to spacer 34 which is slideable on the surface in a track or the like (not shown) thereon. Fixed spacer 34 includes a track 34A and slideable spacer 36 includes a track 36A. An actuating block 38 is disposed between fixed spacer 34 and slideable spacer 36, and has a rail 38A which engages fixed spacer track 34A and a rail 38B which engages slideable spacer track 36A. Actuating block 38 is mounted to shaft 24. Slideable spacer 36 has an edge 36B which is adjacent switch 18.

With reference to FIG. 3, when switch 18, which is spring loaded, is in the "off" position the bottom portion of actuating block 38 extends beyond spacers 34 and 36.

With reference to FIG. 4, when actuating block 38 is displaced in the direction of arrow (a) by knob 22 mounted to shaft 24 being manually pushed in, block rails 38A and 38B slide in spacer tracks 34A and 36A, respectively, whereupon block 38 displaces slideable spacer 36 in the direction of arrow (b) to slide and hence render the switch 18 to the "on" position. Upon actuator block 38 being displaced in the opposite direction by manually pulling knob 22, spring loaded switch 18 returns to the "off" position, with slideable spacer 36 being thereupon displaced to its initial position as shown in FIG. 3.

Thus, switch actuating mechanism 20 including fixed spacer 34, slideable spacer 36 and actuating block 38 attached to shaft 24 is operable via knob 22 also attached to shaft 24 to operate liquid spraying device 2.

It will now be seen that the eyewash system described as aforenoted has particular advantages. The device is battery operated so as to be portable and the batteries may be of the rechargeable type to insure reliable operation of the system. The hood arrangement is such that the user can position the face in the hood opening as required for the eye or eyes to receive the liquid spray from nozzle 10, and which nozzle in itself is pivotable within the hood to provide for aiming the spray. Operation of the device is enhanced by operating knob 22 extending through the front of the hood as will be recognized as desirable.

With the above description of the invention in mind reference is made to the claims appended hereto for a definition of the scope of the invention.

What is claimed is:

1. A battery operated eyewash system of the type including liquid spraying means having a tank containing a liquid and a rechargeable battery operated pump arranged with the tank, whereby operation of the pump through a switch sprays the liquid through a nozzle, characterized by:

a rigid hood secured in front of the liquid spraying means, with the nozzle thereof extending in an opening in the front of the hood;

actuating means for actuating the switch to operate the pump for spraying liquid through the nozzle;

manually operable means for operating the actuating means extending in the front of the hood; and the hood opening in the front of the hood accepting the face of a user, whereby the user positions the eyes for receiving the liquid sprayed through the nozzle when the switch actuating means is manually operated through the operating means to operate the pump to spray the liquid through the nozzle.

2. A system as described by claim 1, characterized by:

the liquid spraying device including a planar surface disposed behind the hood, and the switch being disposed on said planar surface and being actuable thereon for operating the pump; and;

the switch actuating means being disposed on the planar surface in cooperative relation with the switch, and operated by the manual operable means for operating the pump.

3. A system as described by claim 2, wherein the switch actuating means is characterized by:

a first spacer fixed to the planar surface;

a second spacer in spaced relation to the first spacer and displaceable along the length of the planar surface, and having an edge adjacent the switch;

a block disposed between the first and second spacers and coupled to the manually operable means for being displaced thereby substantially normal to the length of the planar surface; and the block and first and second spacers arranged so that displacement of the block by the manually operable means displaces the second spacer to operate the switch.

4. A system as described by claim 3, further characterized by:

the switch being spring loaded and initially in a first position whereby the pump is in an "off" condition; and the manually operable means being operated for displacing the block in one direction, whereby the second spacer is displaced along the length of the planar surface in one direction to operate the switch to a second position for rendering the pump in an "on" condition, and being operated for displacing the block in an opposite direction whereby the second spacer is displaced along the length of the planar surface in an opposite direction with the switch returning to the first position.

5. A system as described by claim 3, further characterized by:

the first and second spacers having tracks;

the block having a pair of rails, each of which is received by a corresponding spacer track; and the block rails riding on the spacer tracks when the block is displaced by the manually operable means.

6. A system as described by claim 3, wherein the manually operable means for operating the actuating means is characterized by:

a shaft having one end secured to the block and having an opposite end extending in the front of the hood; and a knob secured to the opposite end of the shaft.

7. A battery operated eyewash system characterized by:

a tank for containing the liquid;

a rechargeable battery operated pump arranged with the tank and disposed in a housing secured to the tank;

liquid conduit means coupled to the pump and including a spray nozzle;

a switch associated with the pump and arranged on the pump housing for operating the pump to pump liquid from the tank through the liquid conduit means and the spray nozzle;

a rigid hood secured to the pump housing so as to be in front of said housing and tank;

the hood having an opening in the front thereof, and the spray nozzle extending in said opening;

actuating means arranged on the pump housing and arranged with the switch to operate the pump;

manually operable means extending in the front of the hood for operating the actuating means; and the hood opening accepting the face of a user, whereby the user positions the eyes for receiving the liquid sprayed through the nozzle when the switch actuating means is manually operated through the operating means to operate the pump to spray liquid through the nozzle.

* * * * *